US008833581B2

(12) United States Patent
Kuo et al.

(10) Patent No.: US 8,833,581 B2
(45) Date of Patent: Sep. 16, 2014

(54) PACKAGING BOX AND STOP WALL OF PACKAGING BOX

(71) Applicant: Shenzhen China Star Optoelectronics Technology Co., Ltd., Guangdong (CN)

(72) Inventors: Yi-cheng Kuo, Shenzhen (CN); Shih Hsiang Chen, Shenzhen (CN); Jiaxin Li, Shenzhen (CN); Jiahe Cheng, Shenzhen (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 0 days.

(21) Appl. No.: 13/704,974

(22) PCT Filed: Nov. 30, 2012

(86) PCT No.: PCT/CN2012/085593

§ 371 (c)(1),
(2), (4) Date: Dec. 17, 2012

(87) PCT Pub. No.: WO2014/079090

PCT Pub. Date: May 30, 2014

(65) Prior Publication Data

US 2014/0138377 A1 May 22, 2014

(30) Foreign Application Priority Data

Nov. 22, 2012 (CN) ..... 2012 1 0479209

(51) Int. Cl.
*B65D 6/00* (2006.01)
*B65D 8/00* (2006.01)

(52) U.S. Cl.
CPC ..... *B65D 15/24* (2013.01)
USPC ..... 220/4.28; 220/682; 40/741; 40/782; 312/205

(58) Field of Classification Search
USPC ..... 220/4.31, 4.28, 682, 684, 685, 677, 220/551; 40/741, 742, 739, 785, 782, 40/606.13; 312/348.3, 348.1, 334.5, 205; 403/109.1, 109.2, 331, 339; 211/123
See application file for complete search history.

(56) References Cited

U.S. PATENT DOCUMENTS

| | | | | |
|---|---|---|---|---|
| 4,380,856 A * | 4/1983 | Wallace | 29/412 |
| D521,656 S * | 5/2006 | Terrels | D25/122 |
| 8,602,241 B1 * | 12/2013 | Kuo et al. | 220/4.28 |
| 2013/0334082 A1 * | 12/2013 | Zhao et al. | 206/316.1 |

* cited by examiner

*Primary Examiner* — Anthony Stashick
*Assistant Examiner* — Mollie Llewellyn
(74) *Attorney, Agent, or Firm* — Andrew C. Cheng

(57) ABSTRACT

The present invention provides a packaging box and stop wall of packaging box. The packaging box includes at least bottom plate, four third box-body splicing elements and four stop walls. The third box-body splicing element is fixed at each corner of the bottom plate and the two ends of stop wall are connected respectively to the two third box-body splicing elements on a side of the bottom plate and fixed between the two third box-body splicing elements to form with the bottom plate a semi-closed packaging box having open top. As such, the present invention can realize the packaging of liquid crystal panels of different sizes and increase the utilization efficiency of the packaging box to protect the liquid crystal panels as well as reducing packaging cost.

6 Claims, 3 Drawing Sheets

PACKAGING BOX AND STOP WALL OF PACKAGING BOX

BACKGROUND OF THE INVENTION

1. Field of the Invention

The present invention relates to the field of liquid crystal displaying techniques, and in particular to a packaging box and stop wall of packaging box.

2. The Related Arts

As liquid crystal products emerge and undergo fast development, the liquid crystal display device has penetrated many application fields. In the liquid crystal display device, the key element is the liquid crystal panel. During the manufacturing of the liquid crystal display device, it is usual to move a large batch of liquid crystal panels to another location for next process of manufacturing because of division of work.

In known techniques, a packaging box made with foam material is often used for protecting the liquid crystal panel for safety transportation. However, as the foam material is more expensive, the packaging cost is higher when a large amount of liquid crystal panels needs to be transported. Also, because the size of the liquid crystal panel may vary, packaging boxes of different sizes are required to packaging, and packaging boxes cannot be reused to package a liquid crystal panel of a different size, which leads to further packaging cost.

SUMMARY OF THE INVENTION

The technical issue to be addressed by the present invention is to provide a packaging box and stop wall for packaging box, which provides a good protection to the liquid crystal panels and also applicable to packaging liquid crystal panels of different sizes.

The present invention provides a packaging box, which at least comprises: a bottom plate, four third box-body splicing elements and four stop walls; the packaging box being rectangular; each third box-body splicing element being disposed at a corner corresponding to a rectangle, each stop wall comprising a first box-body splicing element, and two second box-body splicing elements connected respectively with the two ends of the first box-body splicing element; number of the first box-body splicing elements of the stop walls being four; wherein two first box-body splicing elements being the first box-body splicing element of long side, and the other two first box-body splicing elements being the first box-body splicing element of short side; the two ends of the first box-body splicing element of the long side being connected respectively through a second box-body splicing element to a corresponding third box-body splicing element for forming the long side of the rectangular packaging box; the two ends of the first box-body splicing element of the short side being connected respectively through a second box-body splicing element to a corresponding third box-body splicing element for forming the short side of the rectangular packaging box; the two long sides of the rectangular packaging box and the two short sides of the rectangular packaging box forming a semi-closed packaging box having open top with the bottom plate; wherein:

One end of the second box-body splicing element being disposed with a first connection part, a second connection part and a third connection part along the length direction with interval, the first connection part, second connection part and third connection part having the same shape; the third connection part forming a second connection unit, the first connection part and the third connection part forming a third connection unit of long side, the second connection part and the third connection part forming the third connection unit of short side;

Two ends of each first box-body splicing element being disposed with a first connection unit, the first connection unit being disposed along the length direction of the first box-body splicing element with interval and being connected to the fourth connection part and the fifth connection part, which having complementary shape to the first connection part; the fourth connection part and the fifth connection part forming a first connection unit; the first connection unit being connected to the third connection unit of the long side or the third connection unit of the short side to realize the short length of the stop wall; the fifth connection part of the first connection unit being connected to the second connection unit to realize the long length of the stop wall; the first connection unit at the two ends of the first box-body splicing element of the long side being first connection unit of the long side, and the first connection unit at the two ends of the first box-body splicing element of the short side being first connection unit of the short side; wherein the first connection unit of the long side being for connecting the third connection unit of the long side; distance between the fourth connection part and the fifth connection part of the first connection unit of the long side being distance between the first connection part and the third connection part of the third connection unit of the long side; the first connection unit of short side being for connecting the third connection unit of short side; distance between the fourth connection part and the fifth connection part of the first connection unit of the short side being distance between the second connection part and the third connection part of the third connection unit of short side;

The other end of the second box-body splicing element being disposed with a fourth connection unit;

The third box-body splicing element comprising two fifth connection units, the two fifth connection units being disposed to form a right angle and being connected respectively to the fourth connection unit of the second box-body splicing element at the end of the two stop walls adjacent to the third box-body splicing element and close to the third box-body splicing element; each fifth connection unit being disposed with foam material, the foam material forming mechanism complementary to the structure of the fourth connection unit; the foam material of the two fifth connection units interfacing respectively with corresponding fourth connection unit of the two second box-body splicing elements to realize connection between the fifth connection unit and corresponding fourth connection unit.

The present invention provides a stop wall of packaging box, which at least comprises: a first box-body splicing element and a second box-body splicing element; at least one end of the first box-body splicing element being connected to the second box-body splicing element; wherein the first box-body splicing element comprising a first connection unit disposed at the at least one end of the box-body splicing element; the second box-body splicing element comprising a second connection unit and a third connection unit, disposed at a same end and distributed respectively along the length direction of the second box-body splicing element; the second connection unit and the third connection unit being for selectively connecting to the first connection unit at one end of the first box-body splicing element so as to realize varying length of the stop wall.

According to a preferred embodiment of the present invention, the second box-body splicing element is disposed with a first connection part, a second connection part and a third connection part along the length direction with interval, the first connection part, second connection part and third connection part have the same shape; the third connection part forms a second connection unit, the first connection part and the third connection part form a third connection unit of long side, the second connection part and the third connection part form the third connection unit of short side;

The first box-body splicing element is disposed with a first connection unit, the first connection unit is disposed along the length direction of the first box-body splicing element with interval and is connected to the fourth connection part and the fifth connection part, which have complementary shape to the first connection part; the fourth connection part and the fifth connection part form a first connection unit; the first connection unit is connected to the third connection unit of the long side or the third connection unit of the short side to realize the short length of the stop wall; the fifth connection part of the first connection unit is connected to the second connection unit to realize the long length of the stop wall.

According to a preferred embodiment of the present invention, the first connection part, the second connection part and the third connection part are a first concave trench having the same shape; the fourth connection part and the fifth connection part are a first protruding mechanism complementary to match the first concave trench.

The present invention provides a packaging box, which comprises: a bottom plate, four third box-body splicing elements and four stop walls; the stop wall being an aforementioned first stop wall; the packaging box being rectangular; each third box-body splicing element being fixed at a corner of the bottom plate; the two ends of the stop wall being connected respectively to the third box-body splicing element corresponding to one side of the bottom plate for fixed between the above two third box-body splicing elements and forming with the bottom plate a semi-closed packaging box having open top.

According to a preferred embodiment of the present invention, the packaging box is rectangular; each third box-body splicing element is disposed at a corner corresponding to a rectangle, number of the first box-body splicing elements of the stop walls is four; two ends of each first box-body splicing element are disposed with a first connection unit; wherein two first box-body splicing elements are the first box-body splicing element of long side, and the other two first box-body splicing elements are the first box-body splicing element of short side; each first box-body splicing element is connected correspondingly to two second box-body splicing elements; the two ends of the first box-body splicing element of the long side are connected respectively through a second box-body splicing element to a corresponding third box-body splicing element for forming the long side of the rectangular packaging box; the two ends of the first box-body splicing element of the short side are connected respectively through a second box-body splicing element to a corresponding third box-body splicing element for forming the short side of the rectangular packaging box.

According to a preferred embodiment of the present invention, the second box-body splicing element is disposed with a first connection part a second connection part and a third connection part along the length direction with interval, the first connection part, second connection part and third connection part having the same shape; wherein the third connection part forms a second connection unit, a third connection unit connected to the second box-body splicing element of the first box-body splicing element of the long side is the third connection unit of the long side, the first connection part and the third connection part forming the third connection unit of long side; a third connection unit connected to the second box-body splicing element of the first box-body splicing element of the short side is the third connection unit of the short side, the second connection part and the third connection part forming the third connection unit of short side; and The first connection unit of the first box-body splicing element of the stop wall is disposed with a fourth connection part and a fifth connection part along the length direction, the fourth connection part and the fifth connection part have a shape complementary to the first connection part; the fourth connection part and the fifth connection part form a first connection unit; the first connection unit is connected to the third connection unit of the long side or the third connection unit of the short side to realize the short length of the stop wall; the fifth connection part of the first connection unit is connected to the second connection unit to realize the long length of the stop wall; the first connection unit at the two ends of the first box-body splicing element of the long side is first connection unit of the long side, and the first connection unit at the two ends of the first box-body splicing element of the short side is first connection unit of the short side; wherein the first connection unit of the long side is for connecting the third connection unit of the long side; distance between the fourth connection part and the fifth connection part of the first connection unit of the long side is distance between the first connection part and the third connection part of the third connection unit of the long side; the first connection unit of short side is for connecting the third connection unit of short side; distance between the fourth connection part and the fifth connection part of the first connection unit of the short side is distance between the second connection part and the third connection part of the third connection unit of short side.

According to a preferred embodiment of the present invention, the second box-body splicing element further comprises a fourth connection unit; the fourth connection unit is disposed at one end of the second box-body splicing element connected to the third box-body splicing element; the third box-body splicing element comprises two fifth connection units, the two fifth connection units are disposed to form a right angle and are connected respectively to the fourth connection unit of the two corresponding second box-body splicing elements; wherein the two corresponding second box-body splicing elements are the second box-body splicing element at the end of the two stop walls adjacent to the third box-body splicing element.

According to a preferred embodiment of the present invention, the first connection part, the second connection part and the third connection part of the second box-body splicing element are a first concave trench having the same shape; the fourth connection part and the fifth connection part of the first box-body splicing element are a first protruding mechanism complementary to match the first concave trench; the fifth connection unit of the third box-body splicing element is disposed as a second concave trench and the fourth connection unit of the second box-body splicing element is disposed as a second first protruding mechanism complementary to match the second concave trench.

According to a preferred embodiment of the present invention, the fifth connection unit is disposed with foam material, and the foam material forms the second concave trench.

According to a preferred embodiment of the present invention, the packaging box is made of plastic material.

The efficacy of the present invention is that to be distinguished from the state of the art. The third box-body splicing element, stop wall and bottom plate of the present invention are assembled to form a packaging box. When packaging liquid crystal panels of different sizes, the length of stop wall can be varied accordingly to match the bottom plate of different sizes to realize the packaging of liquid crystal panels of different sizes and increase the utilization efficiency of the packaging box to protect the liquid crystal panels as well as reducing packaging cost.

BRIEF DESCRIPTION OF THE DRAWINGS

To make the technical solution of the embodiments according to the present invention, a brief description of the drawings that are necessary for the illustration of the embodiments will be given as follows. Apparently, the drawings described below show only example embodiments of the present invention and for those having ordinary skills in the art, other drawings may be easily obtained from these drawings without paying any creative effort. In the drawings.

DETAILED DESCRIPTION OF THE PREFERRED EMBODIMENTS

The following refers to drawing and embodiments for description.

Figure 1:
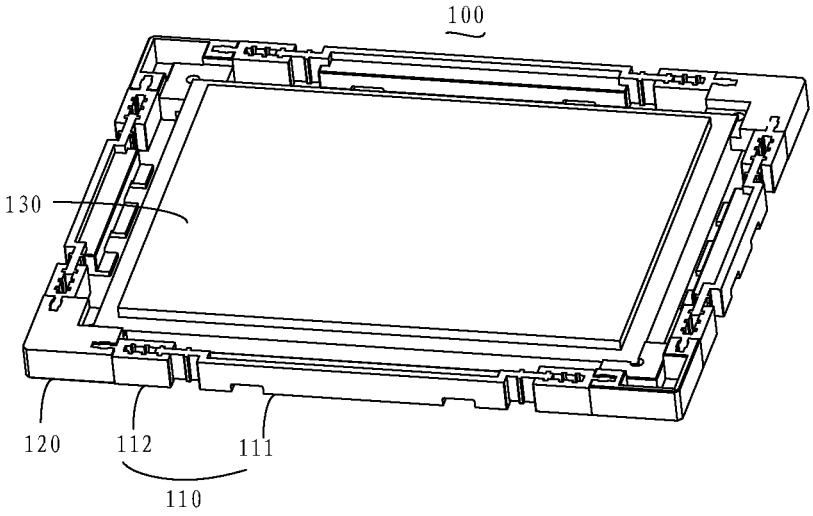
FIG. 1 is a schematic view showing the structure of an embodiment of a packaging box according to the present invention.
Figure 2:
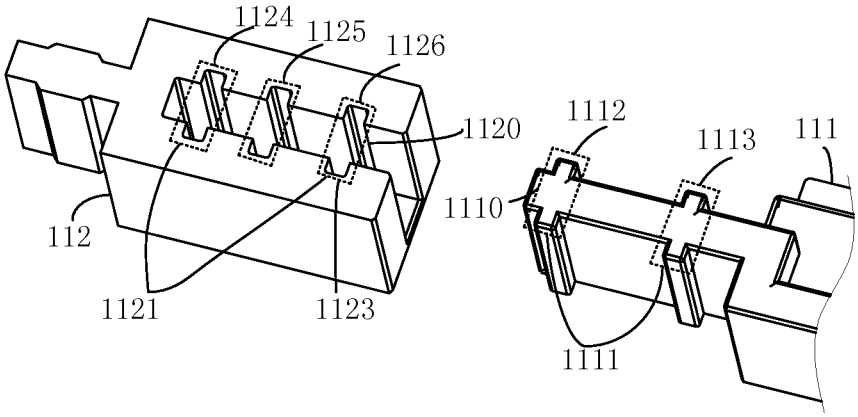
FIG. 2 is a schematic view showing the partial structure of the first box-body splicing element and second box-body splicing element of long side in an embodiment of a packaging box according to the present invention.
Figure 3:
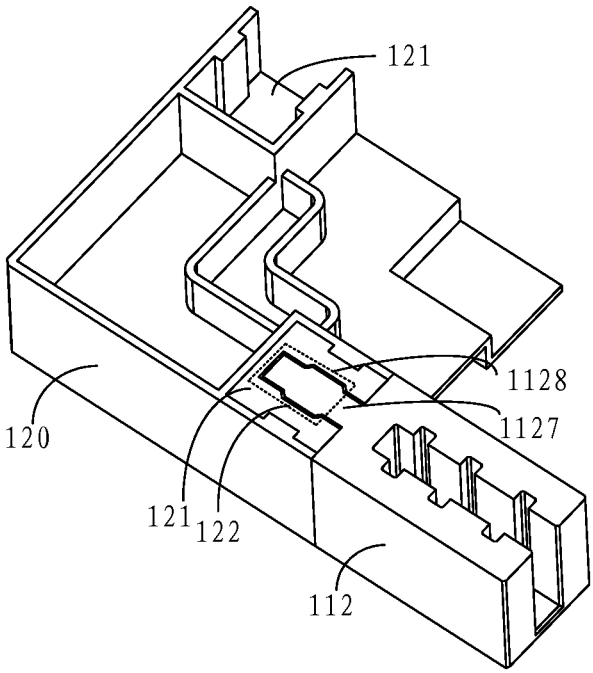
FIG. 3 is a schematic view showing the partial structure of the second box-body splicing element and third box-body splicing element in an embodiment of a packaging box according to the present invention.

Referring to FIGS. 1-3, FIG. 1 is a schematic view showing the structure of an embodiment of a packaging box according to the present invention; FIG. 2 is a schematic view showing the partial structure of the first box-body splicing element and second box-body splicing element of long side in an embodiment of a packaging box according to the present invention. In the instant embodiment, a packaging box 100 comprises four stop walls 110, four third box-body splicing elements 120 and a bottom plate 130; wherein the stop wall 110 comprises a first box-body splicing element 111 and a second box-body splicing element 112.

The third box-body splicing element 120 is disposed at each corner of the bottom plate 130. In the instant embodiment, the bottom plate 130 is rectangular, and the third box-body splicing element 120 is disposed at the four corners of the rectangular bottom plate 130. The stop wall 110 comprises a first box-body splicing element 111 and two second box-body splicing elements 112. One end of each of the two second box-body splicing elements 112 is connected to one of the two ends of the first box-body splicing element 111 to form the stop wall 110. The other end of each of the two second box-body splicing elements 112 is connected respectively to a corresponding third box-body splicing element 120 so that the stop wall 110 is fixed through the second box-body splicing element 112 between the two third box-body splicing elements 120 corresponding to a side of the rectangular bottom plate 130 to form the semi-closed packaging box 100 with an open top.

Specifically, the following takes the stop wall 110 of long side of the packaging box 100 as an example to describe the stop wall 110 of the packaging box 100 in details. In the instant embodiment, one end of the second box-body splicing element 112 has an overall shape of a fork structure with a long open trench at the end surface. The two opposite inner walls of the long trench are disposed with, from left to right, a first connection part 1124, a second connection part 1125 and a third connection part 1126, at different locations distributed along length direction and yet having the same shape. The first connection part 1124, the second connection part 1125 and the third connection part 1126 are disposed as first concave trenches on the two opposite inner walls of the long trench. The first connection part 1124 and the third connection part 1126, or the second connection part 1125 and the third connection part 1126 together form a mechanism for connecting the second box-body splicing element 112. In the instant embodiment, the first connection part 1124 and the third connection part 1126 together form the third connection unit 1121 of the first box-body splicing element 111 of long side of the packaging box 100. The third connection part 1126 alone forms the second connection unit 1123.

Correspondingly, the two ends of the first box-body splicing element 111 are disposed with respectively a first connection unit 1111. The first connection unit 1111 has a shape matching the long trench at one end of the second box-body splicing element 112. Specifically, the two ends of the first box-body splicing element 111 are disposed respectively with fourth connection part 1113 and fifth connection part 1112 along length direction of first box-body splicing element 111. The fourth connection part 1113 and fifth connection part 1112 have the same shape. The fifth connection part 1112 is disposed on the outermost side of the first box-body splicing element 111. The fourth connection part 1113 and the fifth connection part 1112 are disposed as a first protruding mechanism 1110 complementary to any first concave trench 1120 of the second box-body splicing element 112. In the instant embodiment, the distance between the fourth connection part 1113 and the fifth connection part 1112 at one end of the first box-body splicing element 111 of long side of packaging box 100 is the distance between the first connection part 1124 and the third connection part 1126 of the third connection unit 1121 of long side of the packaging box 100. The fourth connection part 1113 and the fifth connection part 1112 together form the first connection unit 1111 of the first box-body splicing element 111 of long side of packaging box 100. The first protruding mechanism 1110 of the first box-body splicing element 111 matches tightly the first concave trench 1120 of the second box-body splicing element 112 to realize the firm connection between the first box-body splicing element 111 and the second box-body splicing element 112.

The first connection unit 1111 of the first box-body splicing element 111 is selectively connected to the third connection unit 1121 or the second connection unit 1123 of the second box-body splicing element 112 to realize varying the length of first box-body splicing element 111. For example, the distance between the fourth connection part 1113 and the fifth connection part 1112 of the first connection unit 1111 is the distance between the first connection part 1124 and the third connection part 1126 of the second box-body splicing element 112. The fourth connection part 1113 and the fifth connection part 1112 of the first connection unit 1111 of the first box-body splicing element 111 match respectively with the first connection part 1124 and the third connection part 1126 of the third connection unit 1121 to realize the short length of the first box-body splicing element 111. In another case, only the first fifth connection part 1112 of the first connection unit 1111 of the box-body splicing element 111 matches the third connection part 1126 of the second connection unit 1123 of the second box-body splicing element 112 to realize the long length of the first box-body splicing element 111.

It should be noted that in the instant embodiment, the second box-body splicing element 112 uses the first concave trench 1120 to form the third connection unit 1121 and the second connection unit 1123; and the first box-body splicing element 111 uses the first protruding mechanism 1110 to form the first connection unit 1111. However, it should not be considered that the second box-body splicing element 112 is restricted to use only the first concave trench 1120 to form the third connection unit 1121 and the second connection unit 1123, and the first box-body splicing element 111 is restricted to use only the first protruding mechanism 1110 to form the first connection unit 1111. In other embodiment, the third connection unit 1121 and the second connection unit 1123 of the second box-body splicing element 112 can also be protruding mechanism, and the first connection unit 1111 of the first box-body splicing element 111 can also be concave trench. Alternatively, the first box-body splicing element 111 and the second box-body splicing element 112 can also use other complementary mechanism to realize the connection. In addition, the third connection unit 1121 and the second connection unit 1123 are not necessarily required to use two opposite inner walls with first concave trench 120 to realize. Other mechanisms, such as, only one inner wall having the a concave trench, can also be used. Correspondingly, the first connection unit 1111 can also adopt ether a mechanism other than matching protruding mechanism. More generally, one end of the second box-body splicing element 112 can be disposed with, instead of a long trench, a plurality of concave trenches on the side of the second box-body splicing element 112 to form the third connection unit 1121 and the second connection unit 1123, and the first connection unit 1111 of the second box-body splicing element 112 also vary varies accordingly. It is obvious that the first box-body splicing element 111 and the second box-body splicing element 112 are not necessarily required to adopt complementary mechanism to realize connection. In other embodiments, the first box-body splicing element 111 and the second box-body splicing element 112 can also use buckle mechanism for connection.

In other embodiments, the description of the stop wall 110 of short side of the packaging box 100 is consistent with the above description of the stop wall 110 of long side; wherein the length of the first box-body splicing element 111 of long side and the length of short side are determined based on actual application, and the distance between the fourth connection part 1113 and the fifth connection part 1112 of the first box-body splicing element 111 of long side is also determined with a certain ratio to the short side. It is obvious that the length of the first box-body splicing element 111 of short and long sides of the packaging box 100 and the distance between the fourth connection part 1113 and the fifth connection part 1112 should be determined based on the actual application. For example, when the packaging box 100 is disposed as a square, correspondingly, the length of the first box-body splicing elements 111 of the four sides of the packaging box 100 can be the same as the distance between the fourth connection part 1113 and the fifth connection part 1112.

More specifically, the other end of the second box-body splicing element 112 is disposed as a second protruding mechanism 1128 to form the fourth connection unit 1127. In the instant embodiment, the third box-body splicing element 120 comprises two side plates disposed to form a right angle (not marked), with a fifth connection unit 121 disposed near the side plate in parallel; wherein the fifth connection unit 121 is disposed as a second concave trench 122 complementary to the second protruding mechanism 1128 of the fourth connection unit 1127. The second protruding mechanism 1128 of the fourth connection unit 1127 complements the second concave trench 122 of the fifth connection unit 121 to realize the firm connection between the second box-body splicing element 112 and the third box-body splicing element 120.

It should be noted that in the instant embodiment, the fifth connection unit 121 of the third box-body splicing element 120 is disposed as second concave trench 122, and the fourth connection unit 1127 of the second box-body splicing element 112 is disposed as second protruding mechanism 1128 complementary to second concave trench 122. However, the fifth connection unit 121 of the third box-body splicing element 120 is not restricted to be disposed as second concave trench 122, and the fourth connection unit 1127 of the second box-body splicing element 112 is not restricted to be disposed as second protruding mechanism 1128 complementary to second concave trench 122. Alternatively, the fifth connection unit 121 and fourth connection unit 1127 can be disposed as any complementary mechanism to realize matching and connection. It is obvious that the fifth connection unit 121 and the fourth connection unit 1127 are not necessarily required to be disposed as complementary mechanism. In other embodiments, the fifth connection unit 121 and the fourth connection unit 1127 can also be disposed as buckle mechanism to realize the firm connection between the second box-body splicing element 112 and the third box-body splicing element 120. In addition, the fifth connection unit 121 of the third box-body splicing element 120 can also be disposed as a mechanism connecting the first box-body splicing element 111 of the stop wall 110 to realize direct connection to one end of the first box-body splicing element 111. At this point, the fifth connection unit 121 is disposed as a mechanism for the second box-body splicing element 112 to connect with one end of the first box-body splicing element 111. The specific description refers to the description of the second box-body splicing element 112, and is not repeated here. In addition, the two side plates of the third box-body splicing element 120 are not necessarily disposed at a right angle, and can be disposed based on the shape of the packaging box 100.

In the instant embodiment, the packaging box 100 is made of plastic material. However, the packaging box 100 is not restricted to be of plastic material. The packaging box 100 can also be made of other material suitable for packaging.

Compared to know technique, the third box-body splicing element, stop wall and bottom plate of the present invention are assembled to form a packaging box. When packaging liquid crystal panels of different sizes, the length of stop wall can be varied accordingly to match the bottom plate of different sizes to realize the packaging of liquid crystal panels of different sizes and increase the utilization efficiency of the packaging box to protect the liquid crystal panels as well as reducing packaging cost.

Figure 4:
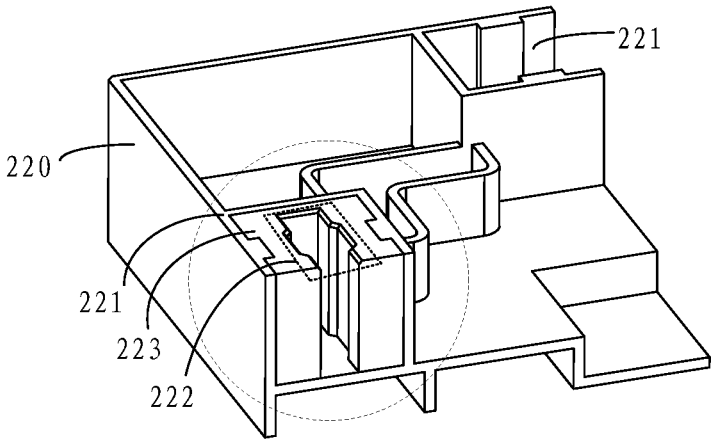
FIG. 4 is a schematic view showing the structure of the third box-body splicing element in another embodiment of a packaging box according to the present invention.
Figure 5:
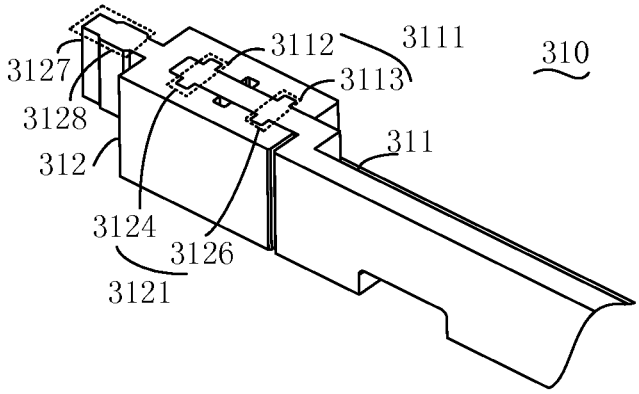
FIG. 5 is a schematic view showing the first case of connecting the first box-body splicing element and second box-body splicing element in an embodiment of a stop wall of packaging box according to the present invention.
Figure 6:
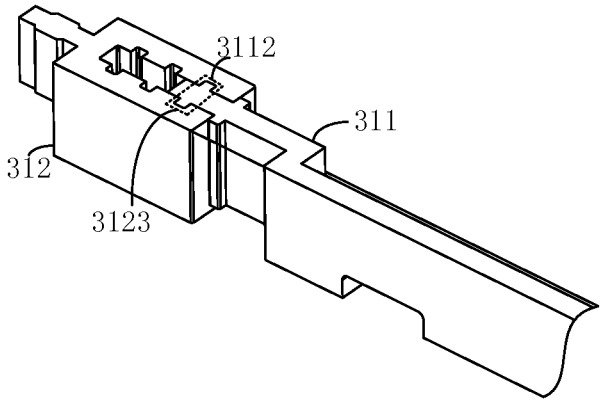
FIG. 6 is a schematic view showing the second case of connecting the first box-body splicing element and second box-body splicing element in an embodiment of a stop wall of packaging box according to the present invention.
Figure 7:
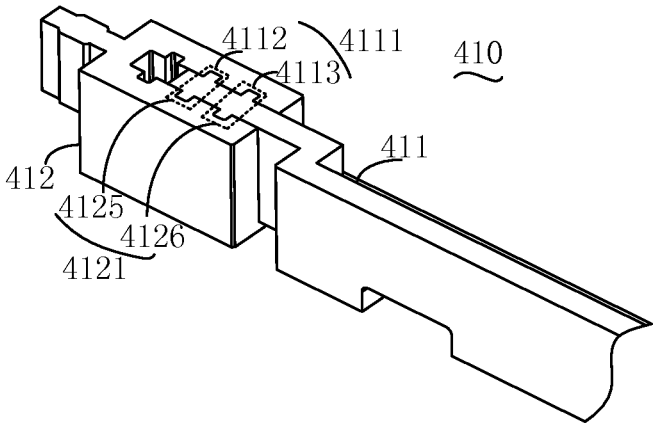
FIG. 7 is a schematic view showing the third case of connecting the first box-body splicing element and second box-body splicing element in an embodiment of a stop wall of packaging box according to the present invention.

Referring to FIGS. 4-7, FIG. 4 is a schematic view showing the structure of the third box-body splicing element in another embodiment of a packaging box according to the present invention. FIG. 5 is a schematic view showing the first case of connecting the first box-body splicing element and second box-body splicing element in an embodiment of a stop wall of packaging box according to the present invention; in other words, the connection of the first box-body splicing element and the second box-body splicing element to realize short length of the stop wall of long side of the packaging box according to the present invention. FIG. 6 is a schematic view showing the second case of connecting the first box-body splicing element and second box-body splicing element in an embodiment of a stop wall of packaging box according to the present invention; in other words, the connection of the first box-body splicing element and the second box-body splicing element to realize long length of the stop wall of long side of the packaging box according to the present invention. FIG. 7 is a schematic view showing the third case of connecting the first box-body splicing element and second box-body splicing element in an embodiment of a stop wall of packaging box according to the present invention; in other words, the connection of the first box-body splicing element and the second box-body splicing element to realize short length of the stop wall of short side of the packaging box according to the present invention. The instant embodiment is a preferred embodiment based on the previous embodiment, and the identical part refers to the above description and will not be described here, Preferably, the first box-body splicing element of the stop wall 310 of long side of the packaging box is the first box-body splicing element 311 of long side, and the first box-body splicing element of the stop wall 410 of short side of the packaging box is the first box-body splicing element 411 of short side. The two ends of the first box-body splicing element 311 of long side are connected through second box-body splicing element 312 to corresponding third box-body splicing element to form long side of rectangular packaging box; the two ends of the first box-body splicing element 411 of short side are connected through second box-body splicing element 412 to corresponding third box-body splicing element to form short side of the packaging box.

Specifically, the two ends of the first box-body splicing element 311 of long side are disposed with first connection unit 3111 of long side; wherein the fourth connection part 3113 and the fifth connection part 3112 at each end of the first box-body splicing element 311 of long side form a first connection unit 3111 of long side. The two end of the first box-body splicing element 411 of short side are disposed with first connection unit 4111 of short side; wherein the fourth connection part 4113 and the fifth connection part 4112 at each end of the first box-body splicing element 411 of short side form a first connection unit 4111 of short side. In the instant embodiment, the distance between the fourth connection part 3113 and the fifth connection part 3112 of the first connection unit 3111 of long side is different from the distance between the fourth connection part 4113 and the fifth connection part 4112 of the first connection unit 4111 of short side.

In the instant embodiment, for the stop wall 310 corresponding to the long side of the packaging box, the distance between the first connection part 3124 and the third connection part 3126 of the second box-body splicing element 312 is the same as the distance between the fourth connection part 3113 and the fifth connection part 3112 of the first connection unit 3111. The first connection part 3124 and the third connection part 3126 of the second box-body splicing element 312 form third connection unit 3121 of long side, and matches the first connection unit 3111 to realize firm connection of the first box-body splicing element 311 and the second box-body splicing element 312 of long side. In another case, the second connection unit 3123 of the second box-body splicing element 312 forms tight match with the fifth connection part 3112 of the first box-body splicing element 311 of long side to realize the another firm connection between first box-body splicing element 311 and the second box-body splicing element 312. At this point, the length of the stop wall 310 becomes longer.

For the stop wall 410 corresponding to the short side of the packaging box, the distance between the second connection part 4125 and the third connection part 4126 of the second box-body splicing element 412 is the same as the distance between the fourth connection part 4113 and the fifth connection part 4112 of the first connection unit 4111. The second connection part 4125 and the third connection part 4126 of the second box-body splicing element 412 form third connection unit 4121 of short side, and matches the first connection unit 4111 to realize firm connection of the first box-body splicing element 411 and the second box-body splicing element 412 of short side. In another case, the second connection unit (i.e., the third connection part 4126) of the second box-body splicing element 412 forms a tight match with the fifth connection part 4112 of the first box-body splicing element 411 of short side to realize the another firm connection between first box-body splicing element 411 and the second box-body splicing element 412. At this point, the length of the stop wall 410 becomes longer.

Specifically, for example, the distance between the fourth connection part 3113 and the fifth connection part 3112 of the first box-body splicing element 311 of long side is 50 cm. The distance between the fourth connection part 4113 and the fifth connection part 4112 of the first box-body splicing element 411 of short side is 30 cm. Correspondingly, as shown in FIG. 5, the distance between first connection part 3124 and the third connection part 3126 of the second box-body splicing element 312 is 50 cm, and as shown in FIG. 7, the distance between the second connection part 4125 and the third connection part 4126 of the second box-body splicing element 412 is 30. The first connection unit 3111 of long side of the first box-body splicing element 311 of long side matches and connects the third connection unit 3121 of long side of the second box-body splicing element 312, and the second box-body splicing element 412 of short side of the first box-body splicing element 411 of short side matches and connects the third connection unit 4121 of short side of the second box-body splicing element 412 to form a packaging box of small size. When the packaging box is required to expand to a box larger than the 50 cm of long side and 30 cm of short side, the fifth connection part 3112 of the first connection unit 3111 of long side of the first box-body splicing element 311 of long side first connection unit 3111 can be connected to the second connection unit 3123 of the second box-body splicing element 312 to realize expanding long side for 50 cm. The fifth connection part 4112 of connection unit 4111 of short side of the first box-body splicing element 411 of short side can be connected to the third connection part 4126 of the second box-body splicing element 412 to realize expanding the short side of packaging box for 30 cm.

Preferably, combined with FIG. 4, the fifth connection unit 221 of the third box-body splicing element 220 is disposed with foam material 223. The foam material 223 fills the inside of the fifth connection unit 221, and forms a mechanism complementary to the shape of the fourth connection unit 3127 of the second box-body splicing element 312. In the instant embodiment, the fourth connection unit 3127 of the second box-body splicing element 312 is disposed as second protruding mechanism 3128. The foam material 223 forms a second concave trench 222 complementary to the second protruding mechanism 3128. The foam material 223 allows the third box-body splicing element 220 and the second box-body splicing element 312 to form interface to realize firm connection.

The present invention further provides an embodiment of stop wall of the packaging box. The stop wall is consistent with the stop wall of the embodiment of the packaging box. The description of the embodiment of the stop wall will not be repeated here.

Compared to know technique, the third box-body splicing element, stop wall and bottom plate of the present invention are assembled to form a packaging box. When packaging liquid crystal panels of different sizes, the length of stop wall can be varied accordingly to match the bottom plate of different sizes to realize the packaging of liquid crystal panels of different sizes and increase the utilization efficiency of the packaging box to protect the liquid crystal panels as well as reducing packaging cost.

Embodiments of the present invention have been described, but not intending to impose any unduly constraint to the appended claims. Any modification of equivalent structure or equivalent process made according to the disclosure and drawings of the present invention, or any application thereof, directly or indirectly, to other related fields of technique, is considered encompassed in the scope of protection defined by the claims of the present invention.

What is claimed is:

1. A packaging box, comprising:

a rectangular bottom plate, four walls comprising two long-side walls and two short-side walls;

the two long-side walls each comprising:

a long-side box-body splicing element with two ends and a second box-body splicing element connected to each end of the long-side box-body splicing element; and the two short-side walls each comprising:

a short-side box-body splicing element with two ends and a second box-body splicing element connected to each end of the short-side box-body splicing element;

the second box-body splicing elements of the short-side walls and the second box-body splicing elements of the lone-side walls have the same structure each of the second box-body splicing elements comprising:

a first and a second end, the first end comprising a first connection part, a second connection part, and a third connection part spaced apart at a distance and having the same shape, the second end comprising a fourth connection unit; and each of the two ends of the long-side box-body splicing elements comprising:

a fourth connection part and a fifth connection part having complimentary shapes to the first, second and third connection parts, wherein the distance between the fourth connection part and the fifth connection part of the long-side box-body splicing elements is equivalent to the distance between the first connection part and the third connection part of the second box-body splicing elements; and each end of the short-side box-body splicing element comprising:

a fourth connection part and a fifth connection part having complimentary shapes to the first, second and third connection parts, wherein the distance between the fourth connection part and the fifth connection part of the short-side box-body splicing elements is equivalent to the distance between the second connection part and the third connection part of the second box-body splicing elements; and four third box-body splicing elements, with one disposed at each corner of the rectangular bottom plate, each third box-body splicing element comprising:

two fifth connection units, disposed with foam material and at right angles with respect to each other;

wherein each fifth connection unit is connected to a fourth connection unit, the foam material conforming to the structure of the fourth connection unit, each end of the long-side box-body splicing elements is connected via one of the second box-body splicing element to one of the third box-body splicing elements, and each end of the short-side box-body splicing elements is connected via one of the second box-body splicing element to one of the third box-body splicing elements to form a semi-closed packaging box having an open top.

2. A packaging box, comprising:

a rectangular bottom plate, four walls comprising two long-side walls and two short-side walls;

the two long-side walls each comprising:

a long-side box-body splicing element with two ends and a second box-body slip element connected to each end of the long-side box-body slicing element; and the two short-side walls each comprising:

a short-side box-body splicing element with two ends and a second box-body splicing element connected to each end of the short-side box-body splicing element;

the second box-body splicing elements of the short-side walls and the second box-body splicing elements of the lone-side walls have the same structure, each of the second box-body splicing elements comprising:

a first and a second end, the first end comprising a first connection part, a second connection part, and a third connection part spaced apart at a distance and having the same shape; and each of the two ends of the long-side box-body splicing elements comprising:

a fourth connection part and a fifth connection part having complimentary shapes to the first, second and third connection parts, wherein the distance between the fourth connection part and the fifth connection part of the long-side box-body splicing elements is equivalent to the distance between the first connection part and the third connection part of the second box-body splicing elements; and each end of the short-side box-body splicing element comprising:

a fourth connection part and a fifth connection part having complimentary shapes to the first, second and third connection parts, wherein the distance between the fourth connection part and the fifth connection part of the short-side box-body splicing elements is equivalent to the distance between the second connection part and the third connection part of the second box-body splicing elements; and four third box-body splicing elements, with one disposed at each corner of the rectangular bottom plate, each third box-body splicing element comprising:

two fifth connection units, at right angles with respect to each other.

3. The packaging box as claimed in claim 2, characterized in that the second end of the second box-body splicing element further comprises a fourth connection unit; the fourth connection unit is connected to the third box-body splicing element;

wherein each fifth connection unit is connected to a fourth connection unit, each end of the long-side box-body splicing elements is connected via one of the second box-body splicing element to one of the third box-body splicing elements, and each end of the short-side box-body splicing elements is connected via one of the second box-body splicing element to one of the third box-body splicing elements to form a semi-closed packaging box having an open top.

4. The packaging box as claimed in claim 3, characterized in that the first, second and the third connection part of the second box-body splicing element each has a first concave trench shape; the fourth connection part and the fifth connection part of the first box-body splicing element each has a first protruding mechanism complementary to match the first concave trench;

the fifth connection unit of the third box-body splicing element is disposed as a second concave trench and the fourth connection unit of the second box-body splicing element is disposed as a second protruding mechanism complementary to match the second concave trench.

5. The packaging box as claimed in claim 4, characterized in that the fifth connection unit is disposed with foam material, and the foam material conforms to the structure of the fourth connection unit.

6. The packaging box as claimed in claim 5, characterized in that the packaging box is made of plastic material.

* * * * *